US008438693B2

(12) United States Patent
Fujiwara

(10) Patent No.: US 8,438,693 B2
(45) Date of Patent: May 14, 2013

(54) ELECTRIC CLEANER

(75) Inventor: Tosiaki Fujiwara, Shiga (JP)

(73) Assignee: Panasonic Corporation, Osaka (JP)

( * ) Notice: Subject to any disclaimer, the term of this patent is extended or adjusted under 35 U.S.C. 154(b) by 882 days.

(21) Appl. No.: 12/377,615

(22) PCT Filed: Aug. 30, 2007

(86) PCT No.: PCT/JP2007/066835

§ 371 (c)(1),
(2), (4) Date: Feb. 16, 2009

(87) PCT Pub. No.: WO2008/032576

PCT Pub. Date: Mar. 20, 2008

(65) Prior Publication Data

US 2010/0281646 A1 Nov. 11, 2010

(30) Foreign Application Priority Data

Sep. 11, 2006 (JP) ..... 2006-245213
Oct. 20, 2006 (JP) ..... 2006-285934

(51) Int. Cl.
*A47L 5/00* (2006.01)

(52) U.S. Cl.
USPC ..... 15/319; 15/339

(58) Field of Classification Search ..... 15/319, 15/320, 331, 347, 350–353, 412, 52.1
See application file for complete search history.

(56) References Cited

U.S. PATENT DOCUMENTS

| | | | | |
|---|---|---|---|---|
| 6,664,748 | B2 * | 12/2003 | Kushida et al. | 318/139 |
| 7,690,078 | B2 * | 4/2010 | Zahuranec et al. | 15/337 |
| 2002/0112315 | A1 * | 8/2002 | Conrad | 15/331 |

FOREIGN PATENT DOCUMENTS

| | | | |
|---|---|---|---|
| GB | 1305166 | | 1/1973 |
| GB | 2409634 | A | 7/2005 |
| JP | 60-212139 | A | 10/1985 |
| JP | 61-050526 | A | 3/1986 |
| JP | 2-243125 | A | 9/1990 |

(Continued)

OTHER PUBLICATIONS

Canadian Office Action for 2,661,182, Sep. 7, 2011, Panasonic Corporation.

(Continued)

*Primary Examiner* — Robert Scruggs
(74) *Attorney, Agent, or Firm* — RatnerPrestia

(57) ABSTRACT

A vacuum cleaner includes a cleaner body capable of standing and inclining, an electric blower accommodated in the cleaner body, a floor nozzle capable of cleaning a surface while the cleaner body inclines, a mode detector detecting whether the cleaner body stands or inclines, and a controller controlling a power supplied to the electric blower. The controller is operable to supply a first power the electric blower if the mode detector detects that the cleaner body inclines, and to supply a second power lower than the first power to the electric blower if the mode detector detects that the cleaner body stands. This vacuum cleaner prevents the electric blower from overheating.

5 Claims, 16 Drawing Sheets

FOREIGN PATENT DOCUMENTS

| | | | |
|---|---|---|---|
| JP | 02-243125 | A | 9/1990 |
| JP | 02-243125 | A | 9/1990 |
| JP | 3-280914 | A | 12/1991 |
| JP | 03-280914 | A | 12/1991 |
| JP | 05-068662 | A | 3/1993 |
| JP | 11-113810 | A | 4/1999 |
| JP | 11-253366 | A | 9/1999 |
| JP | 3-038587 | B2 | 3/2000 |
| JP | 2001-087172 | A | 4/2001 |
| JP | 2001-157655 | A | 6/2001 |
| JP | 2002-233483 | A | 8/2002 |
| JP | 2002-355208 | A | 12/2002 |
| JP | 2004-089246 | A | 3/2004 |
| WO | WO-8911817 | | 12/1989 |

OTHER PUBLICATIONS

European Application Serial No. 07806312.0, Extended European Search Report and Search Opinion mailed Oct. 6, 2011, 8 pgs.

Chinese Office Action for 2007800030446.7 mailed Sep. 20, 2011, 4 pages.

International Search Report for International Application No. PCT/JP2007/066835, Oct. 2, 2007, Panasonic Corp.

* cited by examiner

ELECTRIC CLEANER

This Application is a U.S. National Phase Application of PCT International Application PCT/JP2007/066835.

TECHNICAL FIELD

The present invention relates to a vacuum cleaner.

BACKGROUND ART

FIG. 12 is a rear perspective view of conventional vacuum cleaner 501 described in Patent Document 1. Vacuum cleaner 501 of upright type includes cleaner body 50 and attachments, such as suction unit 51, extension pipe 52, small nozzle 53, dust brush 54, suitable for cleaning various locations. The attachments are mounted to cleaner body 50 so as to be readily used. Floor nozzle 56 is pivotally supported on a rear bottom of cleaner body 50 and sucks dust from a floor.

In order to clean a floor surface, a user grips handle 57 on the upper part of cleaner body 50, have cleaner body 50 lay down, and then, move floor nozzle 56 on the floor surface.

Upon using one of the above attachments, the user removes tip 55A of hose 55 approximating to the floor nozzle. Hose 55 allows a dust chamber for collecting dust to communicate with floor nozzle 56 while cleaner body 50 stands, as shown in FIG. 12. The user operates cleaner body 50 with only hose 55 or with an appropriate attachment attached to tip 55A of hose 55.

A method of controlling such a conventional vacuum cleaner under cleaning circumstances is described in Patent Document 2.

In conventional vacuum cleaner 501, cleaner body 50 operates similarly to the cleaning of the floor when cleaner body 50 stands, as shown in FIG. 12, to use an attachment. Hence, a current flowing into an electric blower accommodated in cleaner body 50 for generating suction airflow is the same as that for an ordinary cleaning. When the standing cleaner operates with hose 55 attached to floor nozzle 56, the volume of air flowing from floor nozzle 56 decreases extremely. Hence, while standing, vacuum cleaner 501 operating for a long time may cause the electric blower to overheat.

When the cleaner stands to attach attachment 51 to 54 to cleaner body 50, the current flowing into the electric blower is the same as that for the ordinary cleaning. An attachment attached to tip 55A of hose 55C decreases the volume of the air to clean.

The type of the attachment may be detected to control the electric blower according to the attachment used. However, in order to perform this, hose 55 necessarily contains conductor wires inside and additionally resistances with different resistances by the attachments. This structure complicates the internal structures of hose 55 and attachments 51 to 54.

Patent Document 1: JP 2001-87172
Patent Document 2: JP 2001-157655

SUMMARY OF THE INVENTION

A vacuum cleaner includes a cleaner body capable of standing and inclining, an electric blower accommodated in the cleaner body, a floor nozzle capable of cleaning a surface while the cleaner body inclines, a mode detector detecting whether the cleaner body stands or inclines, and a controller controlling a power supplied to the electric blower. The controller is operable to supply a first power the electric blower if the mode detector detects that the cleaner body inclines, and to supply a second power lower than the first power to the electric blower if the mode detector detects that the cleaner body stands.

This vacuum cleaner prevents the electric blower from overheating.

REFERENCE NUMERALS

1 Electric Blower
2 Controller
3 Mode detector
6 Timer
8 Hose Detector
9A Attachment Indicator
9B Input Indicator
10 Cleaner Body
16 Floor Nozzle
11 Hose
12 Suction-Power Setting Section
13 Attachment Detector

14 Attachment (Extension Pipe)
24 Attachment Detector
112 Suction-Power Setting Section
155 Attachment (Crevice Nozzle)

DETAILED DESCRIPTION OF PREFERRED EMBODIMENTS

Exemplary Embodiment 1

Figure 1A:
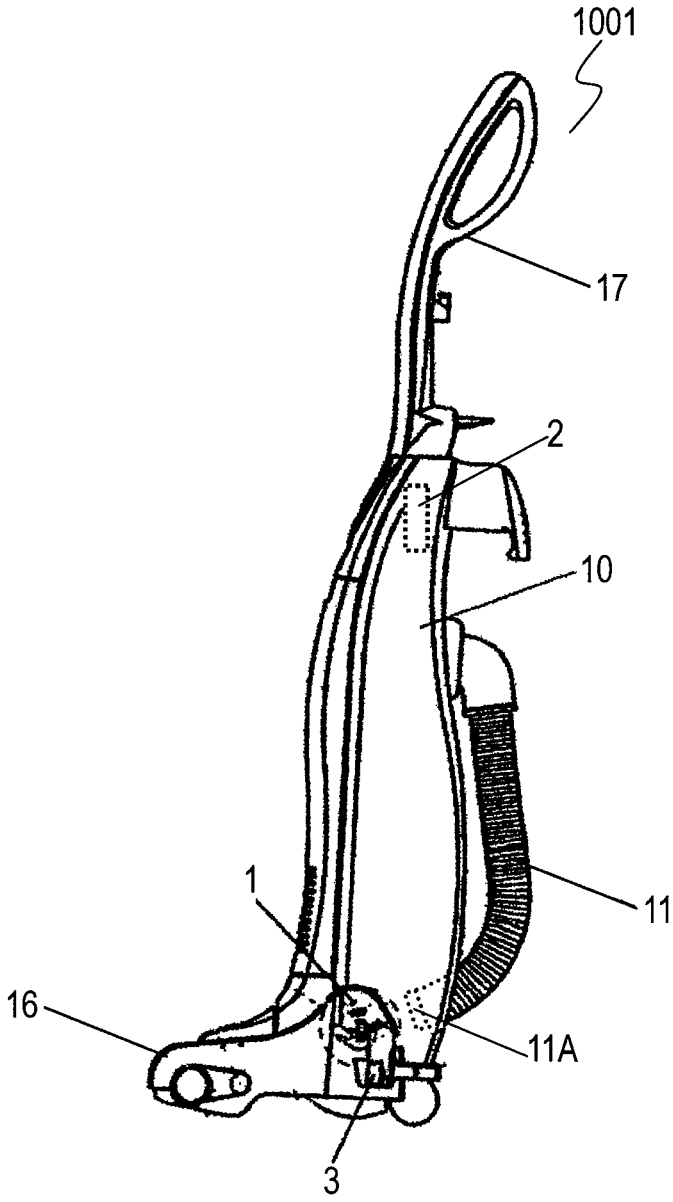
FIG. 1A is a side view of a vacuum cleaner according to Exemplary Embodiment 1 of the present invention.

FIG. 1A is a perspective view of vacuum cleaner 1001 according to the Exemplary Embodiment 1 of the present invention. Vacuum cleaner 1001 of upright type includes cleaner body 10 including handle 17 for operation, electric blower 1 accommodated in cleaner body 10, and floor nozzle 16 pivotably attached to a bottom of cleaner body 10. Cleaner body 10 includes mode detector 3 detecting whether cleaner body 10 stands in a standing mode or inclines in an inclining mode, that is, is in an ordinary cleaning, and controller 2 controlling electric blower 1. Hose 11 allows a dust chamber inside cleaner body 10 communicate with floor nozzle 16. Hose 11 has tip 11A attachable to floor nozzle 16 detachably.

Figure 1B:
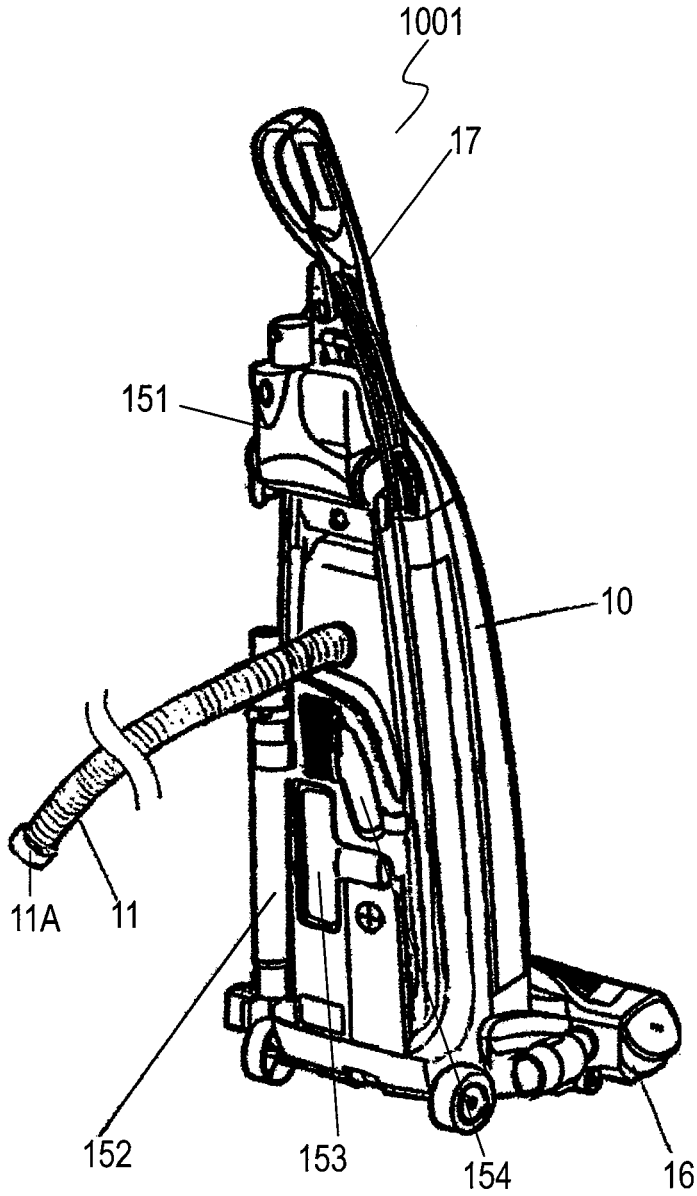
FIG. 1B is a rear perspective view of the vacuum cleaner according to Embodiment 1.

FIG. 1B is a rear perspective view of vacuum cleaner 1001. Attachments 151 to 154 suitable for cleaning various locations are attached to cleaner body 10. According to Embodiment 1, attachments 151 to 154 are a suction unit, an extension pipe, a small nozzle, and a dust brush, respectively. Floor nozzle 16 pivotally supported on the lower portion of cleaner body 10 sucks dust from a floor.

In order to clean a floor surface, a user grips handle 17 provided at an upper portion of cleaner body 10, lays cleaner body 10, and then, moves floor nozzle 16 on the floor surface.

Upon using, for example, attachment 153, the small nozzle, the user stands cleaner body 10, and attaches attachment 153 to tip 11A of hose 11 to operate cleaner body 10.

Figure 2A:
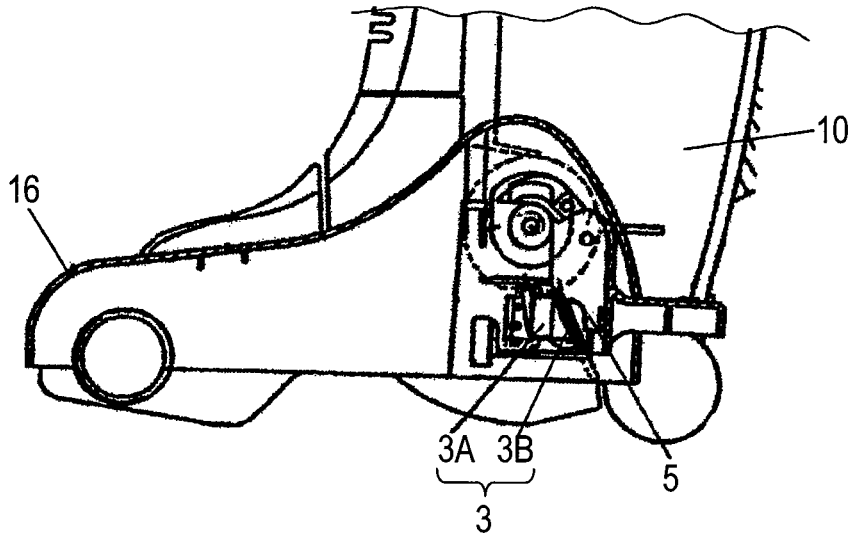
FIG. 2A is a sectional view of an essential part of the vacuum cleaner according to Embodiment 1.
Figure 2B:
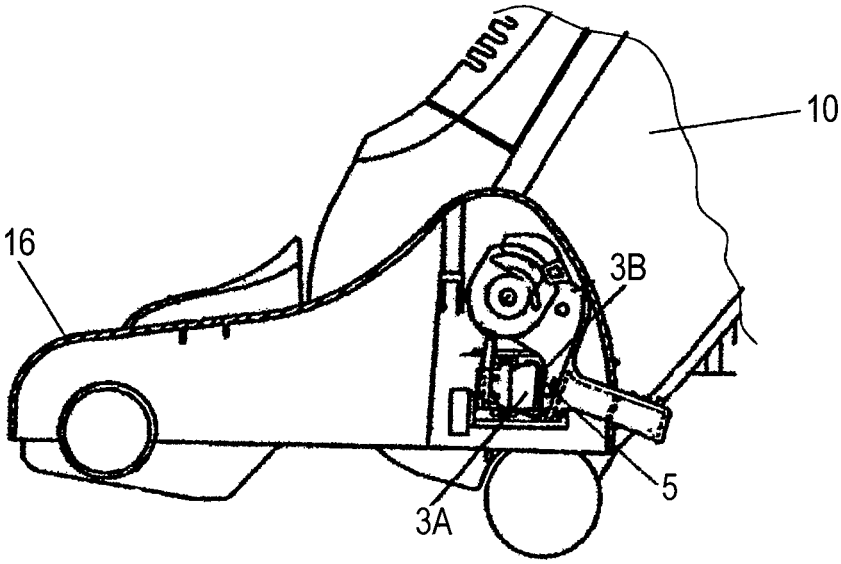
FIG. 2B is a sectional view of an essential part of the vacuum cleaner according to Embodiment 1.

FIGS. 2A and 2B are sectional views of essential portions of vacuum cleaner 1001. Mode detector 3 is implemented by microswitch 3A activated with lever 3B. Lever 3B is operated with projection 5 unitarily formed with cleaner body 10. As shown in FIG. 2A, while cleaner body 10 stands, projection 5 does not operate lever 3B, and does not activating microswitch 3A, thus turning off microswitch 2A. As shown in FIG. 2B, while floor nozzle 16 cleans a floor in an ordinary cleaning mode, cleaner body 10 inclines backward. In this case, projection 5 operates lever 3B to activate microswitch 3A, thus turning on microswitch 3A.

Figure 3:
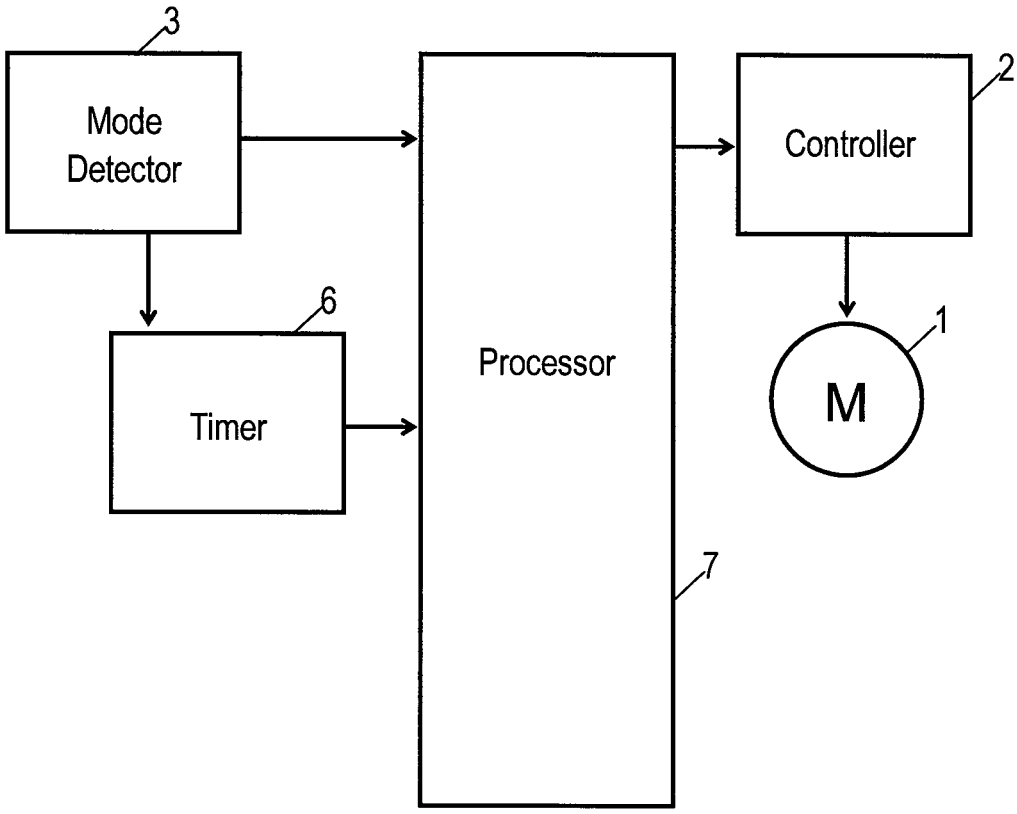
FIG. 3 is a circuit block diagram of the vacuum cleaner according to Embodiment 1.

FIG. 3 is a circuit block diagram of vacuum cleaner 1001. Timer 6 measures, based on a signal output from mode detector 3 (microswitch 3A), a duration during which the cleaner operates with cleaner body 10 standing. Processor 7 outputs, to controller 2, a signal indicating a power to be supplied to electric blower 1 according to signals from mode detector 3 and timer 6.

Figure 4:
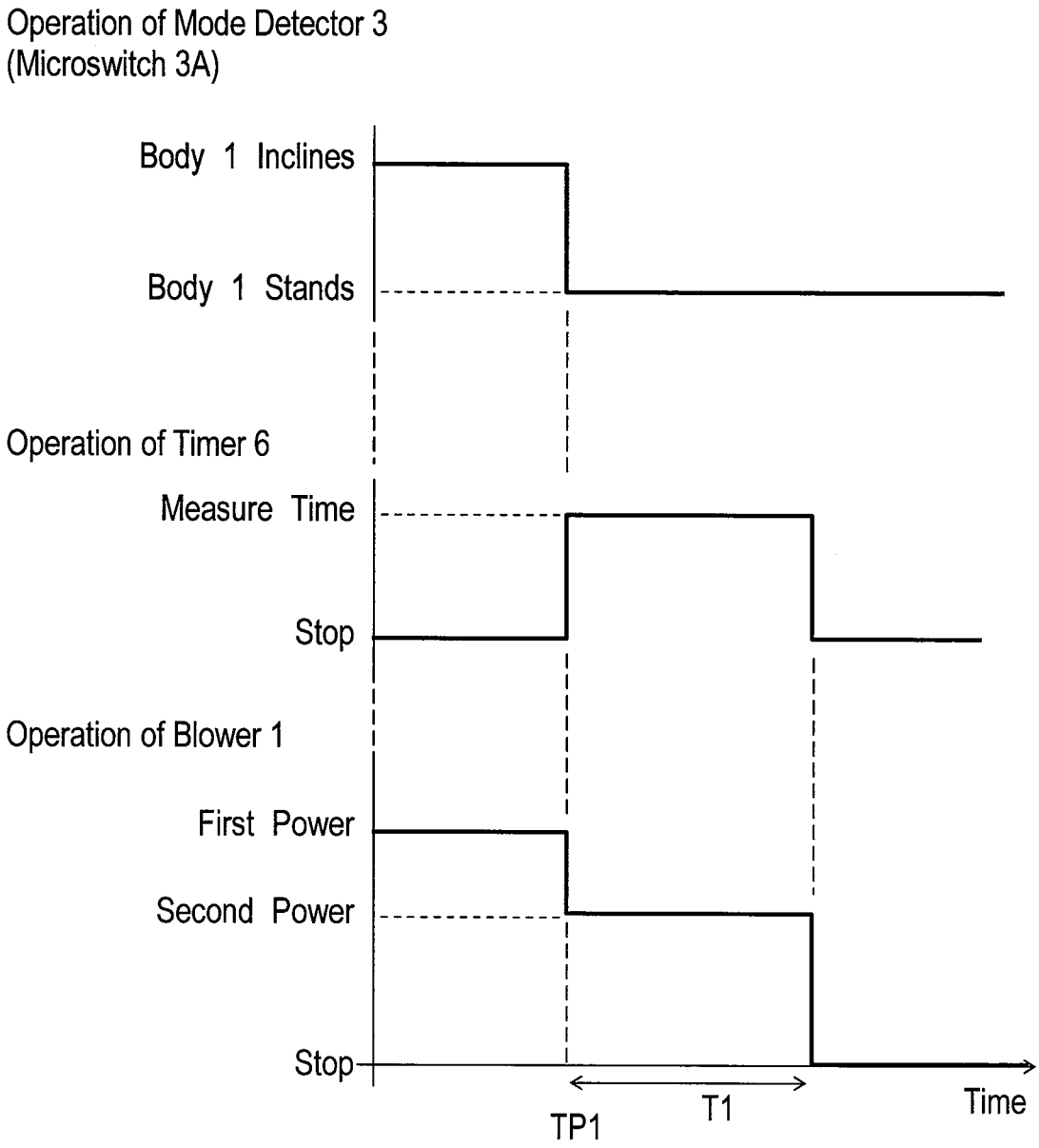
FIG. 4 illustrates an operation of the vacuum cleaner according to Embodiment 1.

An operation of vacuum cleaner 1001 will be described below. FIG. 4 illustrates the operation of vacuum cleaner 1001.

While floor nozzle 16 cleans a floor in the ordinary cleaning mode, as shown in FIG. 2B, microswitch 3A is activated, that is turned on, and timer 6 is stopped. At this moment, processor 7 outputs, to controller 2, a signal directing controller 2 to supply first power to electric blower 1 to cause electric blower 1 to operate with the first power.

When the cleaner operates with cleaner body 10 standing at time point TP1 to execute cleaning with attachment 153, microswitch 3A is turned off, as shown in FIG. 2A, and timer 6 starts to measure a time elapsing from time point TP1 to measure the duration during which electric blower 1 operates with cleaner body 10 standing in the standing mode. While electric blower 1 operates with cleaner body 10 standing, processor 7 outputs, to controller 2, a signal directing controller 2 to supply a second power to electric blower 1 according to a signal from microswitch 3A (mode detector 3), thereby causing electric blower 1 to continue operating with the second power. The second power is lower than the first power.

When the time measured by timer 6 exceeds a predetermined time (e.g. 3 minutes), processor 7 outputs, to controller 2, a signal for stopping electric blower 1, thereby causing electric blower 1 to stop.

As described above, vacuum cleaner 1001 according to Embodiment 1 reduces the power supplied to electric blower 1 while cleaner body 10 is in the standing mode. This operation prevents electric blower 1 from overheating even when the amount of air suctioned through floor nozzle 16 decreases. The cleaner stops safely after the predetermined time (e.g. 3 minutes) even if operating with cleaner body 10 standing in the standing mode for a long time

Exemplary Embodiment 2

Figure 5:
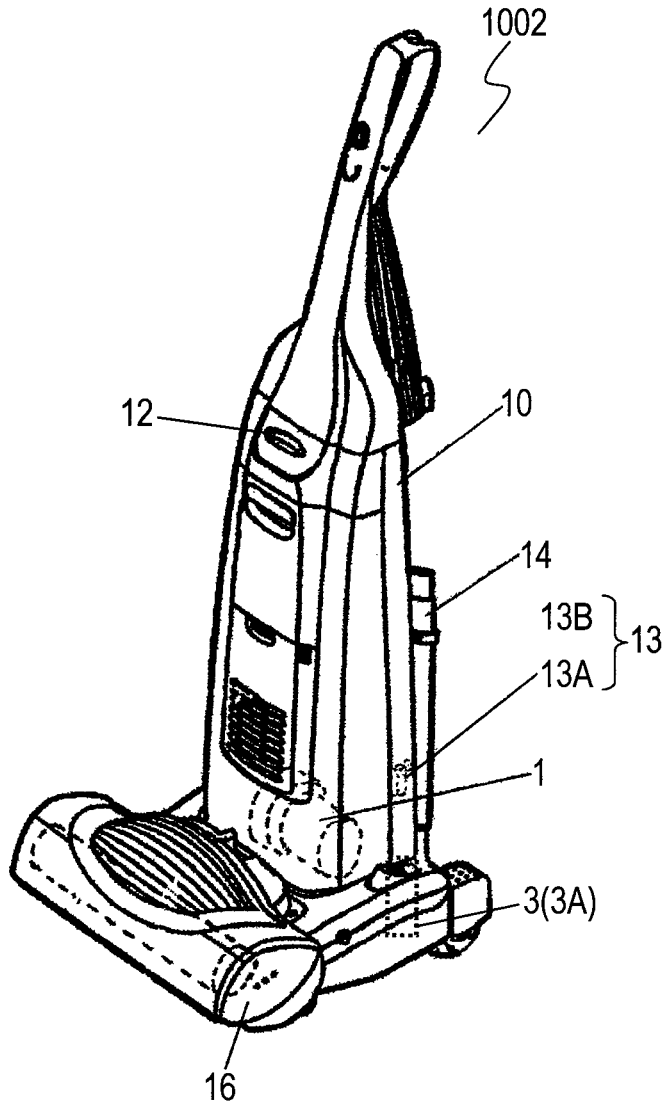
FIG. 5 is a perspective view of a vacuum cleaner according to Exemplary Embodiment 2 of the invention.
Figure 6A:
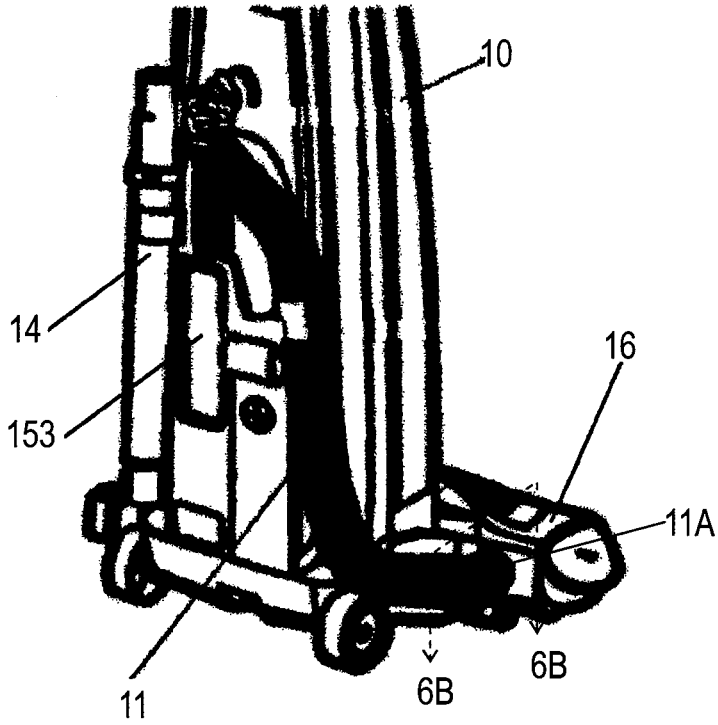
FIG. 6A is a partial perspective view of the vacuum cleaner according to Embodiment 2.
Figure 6B:
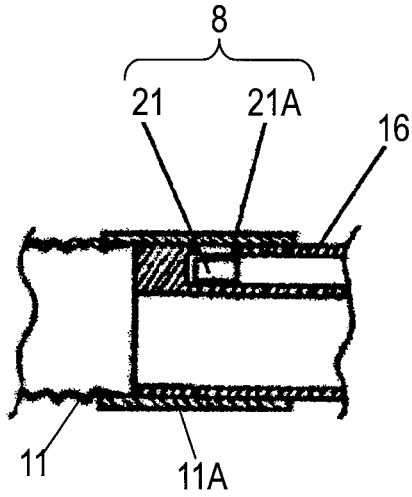
FIG. 6B is a sectional view of the vacuum cleaner at line 6B-6B shown in FIG. 6A.
Figure 6C:
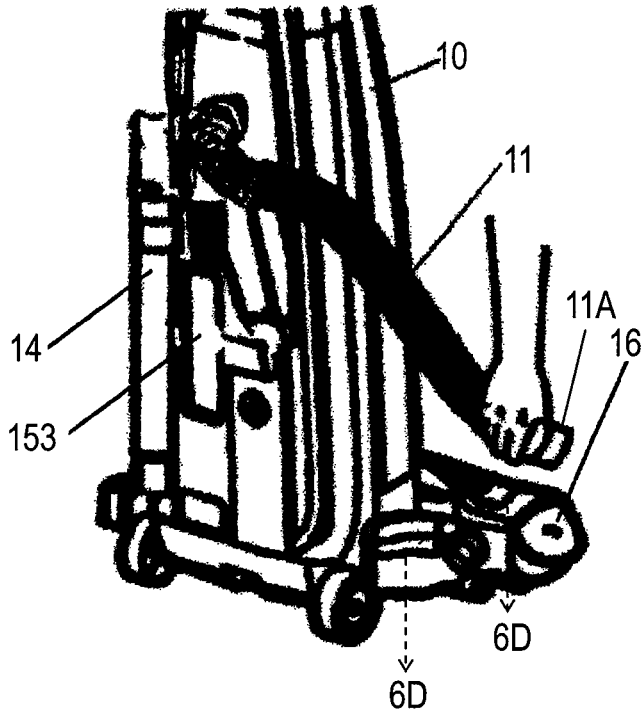
FIG. 6C is a partial perspective view of the vacuum cleaner according to Embodiment 2.
Figure 6D:
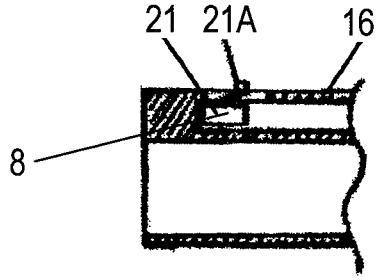
FIG. 6D is a sectional view of the vacuum cleaner at line 6D-6D shown in FIG. 6C.

FIG. 5 is a perspective view of vacuum cleaner 1002 according to Exemplary Embodiment 2 of the present invention. FIG. 6A is a partial perspective view of vacuum cleaner 1002. FIG. 6B is a sectional view of vacuum cleaner 1002 at line 6B-6B shown in FIG. 6A. FIG. 6C is a partial perspective view of vacuum cleaner 1002. FIG. 6D is a sectional view of vacuum cleaner 1002 at line 6C-6C shown in FIG. 6C. FIG. 7 is a circuit block diagram of vacuum cleaner 1002. In FIGS. 5 to 7, components identical to those of vacuum cleaner 1001 according to the embodiment shown in FIGS. 1 to 4 are denoted by the same reference numerals, and their description will be omitted.

Hose detector 8 is provided at floor nozzle 16, and detects whether or not tip 11A of hose 11 is attached to floor nozzle 16. According to Embodiment 2, hose detector 8 includes microswitch 21. As shown in FIG. 6A, if tip 11A of hose 11 is attached to floor nozzle 16, the inner surface of hose 11 presses lever 21A of microswitch 21, as shown in FIG. 6B, to activate microswitch 21 to turn on microswitch 21. As shown in FIG. 6C, when tip 11A of hose 11 is detached from floor nozzle 16, lever 21A of microswitch 21 is not pushed, as shown in FIG. 6D, thus microswitch 21 does not operate and is turned off.

Figure 6E:
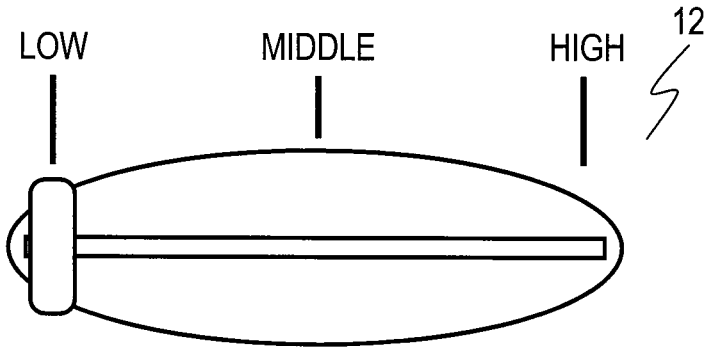
FIG. 6E is an enlarged partial view of the vacuum cleaner according to Embodiment 2.
Figure 7:
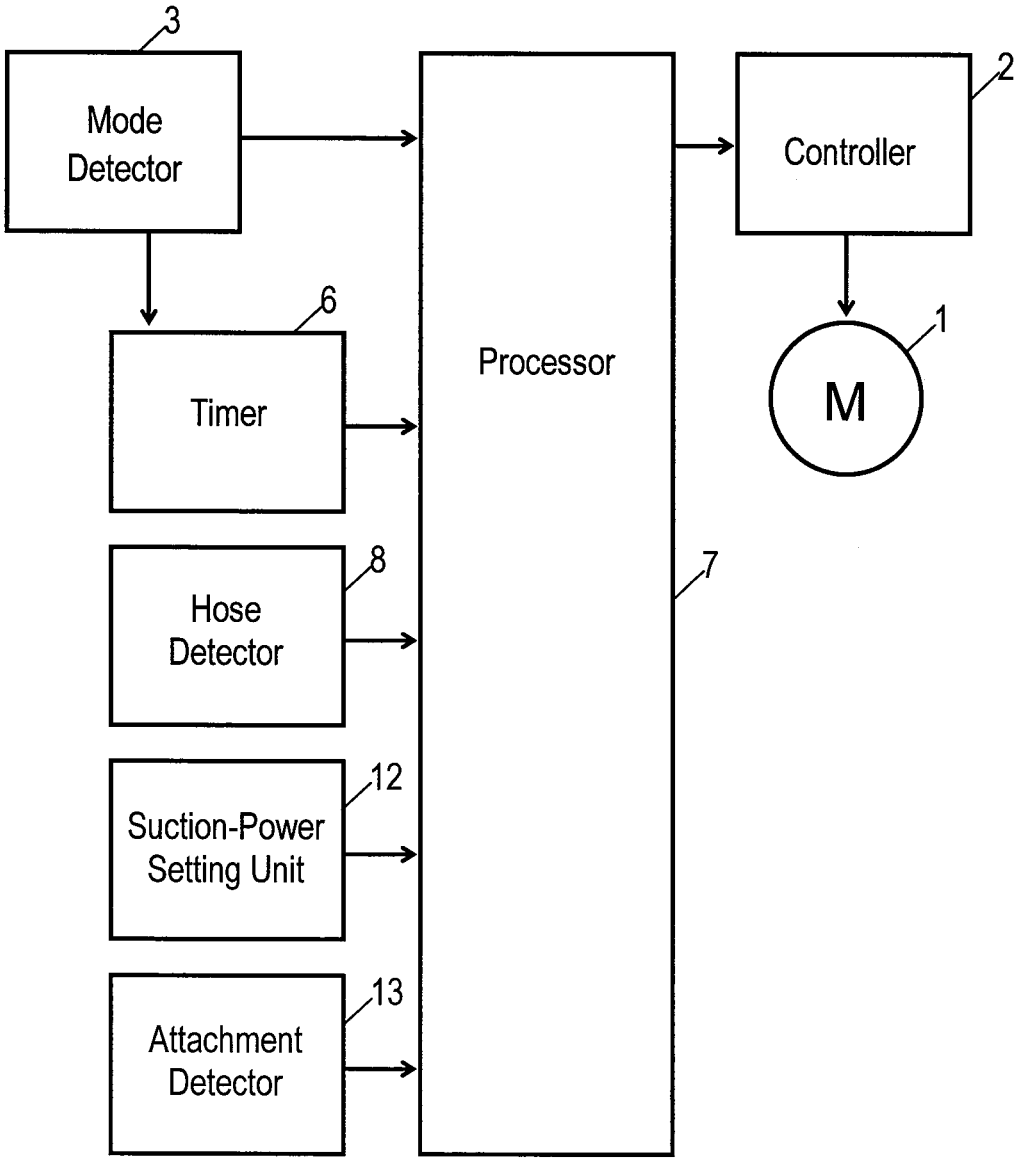
FIG. 7 is a circuit block diagram of the vacuum cleaner according to Embodiment 2.

FIG. 6E is an enlarged partial view of vacuum cleaner 1002 for illustrating suction-power setting section 12. While cleaner body 10 stands and hose 11 is detached from floor nozzle 16, a user changes a power supplied from controller 2 to electric blower 1 to set a suction power by operating suction-power setting section 12. When the user executing cleaning with tip 11A of hose 11 detached from floor nozzle 16 or with an attachment attached to tip 11A of hose 11, the user can set the suction power according to a surface to be cleaned, thus using vacuum cleaner 1002 easily.

Attachment detector 13 discriminates the type of an attachment attached to tip 11A of hose 11. According to Embodiment 2, in order to detect whether or not attachment 14 (an extension pipe) is attached to hose 11, attachment detector 13 includes microswitch 13A provided inside cleaner body 10. When attachment 14 (the extension pipe) is attached to cleaner body 10, attachment 14 operates lever 13B of microswitch 13A to activate microswitch 13A to turn on microswitch 13A. When attachment 14 is detached from cleaner body 10, lever 13B is not operated, and microswitch 13A is turned off. Attachment detector 13 thus detects whether or not attachment 14 is detached from cleaner body 10.

Signals from hose detector 8, suction-power setting section 12, and attachment detector 13 are input to processor 7. According to these signals, processor 7 outputs, to controller 2, a signal indicating the power to be supplied to electric blower 1.

Figure 8:
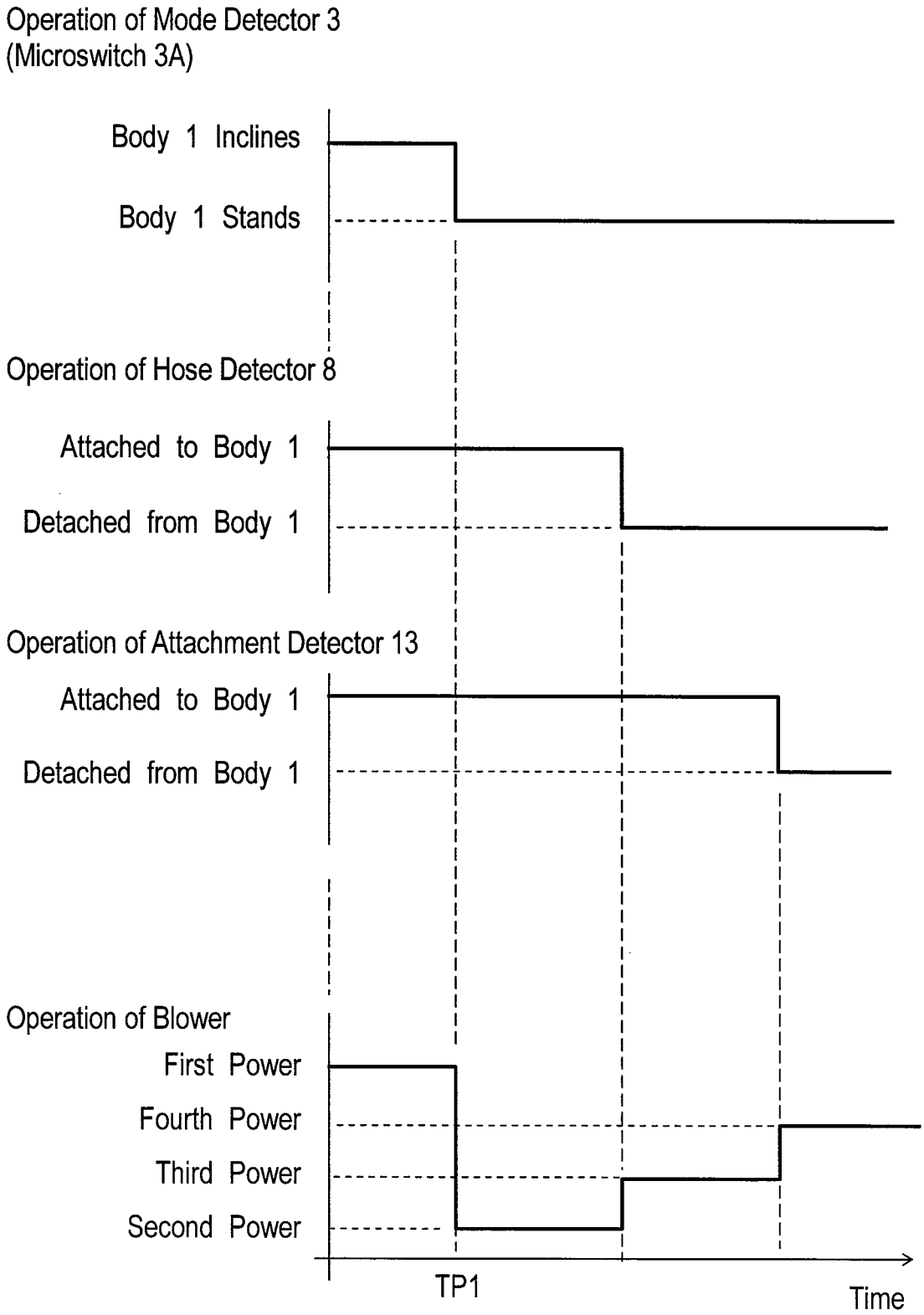
FIG. 8 illustrates an operation of the vacuum cleaner according to Embodiment 2.

An operation of vacuum cleaner 1002 will be described below. FIG. 8 illustrates the operation of vacuum cleaner 1002.

When the user cleans a floor with floor nozzle 16 while cleaner body 10 inclines in an ordinary cleaning mode, microswitch 3A is activated and turned on. At this moment, processor 7 outputs, to controller 2, a signal directing controller 2 to supply a first power to electric blower 1, thereby causing electric blower 1 to operate with the first power.

When the cleaner operates with cleaner body 10 standing in a standing mode at time point TP1 in order to execute cleaning with attachment 14 (the extension pipe), microswitch 3A is turned off. While electric blower 1 operates with cleaner body 10 standing, processor 7 outputs, to controller 2, a signal directing controller 2 to supply a second power electric blower 1 according to a signal from microswitch 3A (mode detector 3), thereby causing electric blower 1 to continue operating with the second power. The second power is lower than the first power. When the user removes hose 11 from floor nozzle 16 with cleaner body 10 standing in the standing mode, microswitch 21 (hose detector 8) is turned off. When hose detector 8 detects that hose 11 is detached from floor nozzle 16, processor 7 outputs, to controller 2, a signal directing controller 2 to supply a third power to electric blower 1, thereby causing electric blower 1 to operate with the third power. The third power is higher than the second power. This operation allows vacuum cleaner 1002 to ensure sufficient cleaning performance while cleaner body 10 stands in the standing mode. Although the third power is lower than the first, the user can set the third power through suction-power setting section 12.

When the user removes attachment 14 (the extension pipe) from cleaner body 10 in order to clean a remote location, such as a ceiling or a wall surface, microswitch 13A (attachment detector 13) is turned off to detect that attachment 14 is not attached to cleaner body 10, namely detached from cleaner body 10. When attachment detector 13 detects that attachment 14 is detached from cleaner body 10, processor 7 outputs, to controller 2, a signal directing controller 2 to supply a fourth power to electric blower 1, thereby causing electric blower 1 to operate with the fourth power. The fourth power is higher than the third power, and may be higher than the first power. This operation allows electric blower 1 to compensate a loss caused by extension pipe 14, allowing vacuum cleaner 1002 to ensure its cleaning performance. That is, controller 2 changes the power supplied to electric blower 1 according to a detection result of attachment detector 13.

According to Embodiment 2, attachment detector 13 detects whether or not the extension pipe is attached to cleaner body 10. Attachment detector 13 may detect whether or not another type of attachment is attached to cleaner body 10. For example, attachment detector 13 may detect whether or not an attachment, such as a crevice nozzle, with a narrow tip is attached to cleaner body 10. When attachment detector 13 detects that the attachment is attached to cleaner body 10, the fourth power supplied to electric blower 1 may be set to be lower than the second. The fourth power may be set by the user through suction-power setting section 12.

Vacuum cleaner 1002 may not necessarily include mode detector 3 or timer 6.

Exemplary Embodiment 3

Figure 9A:
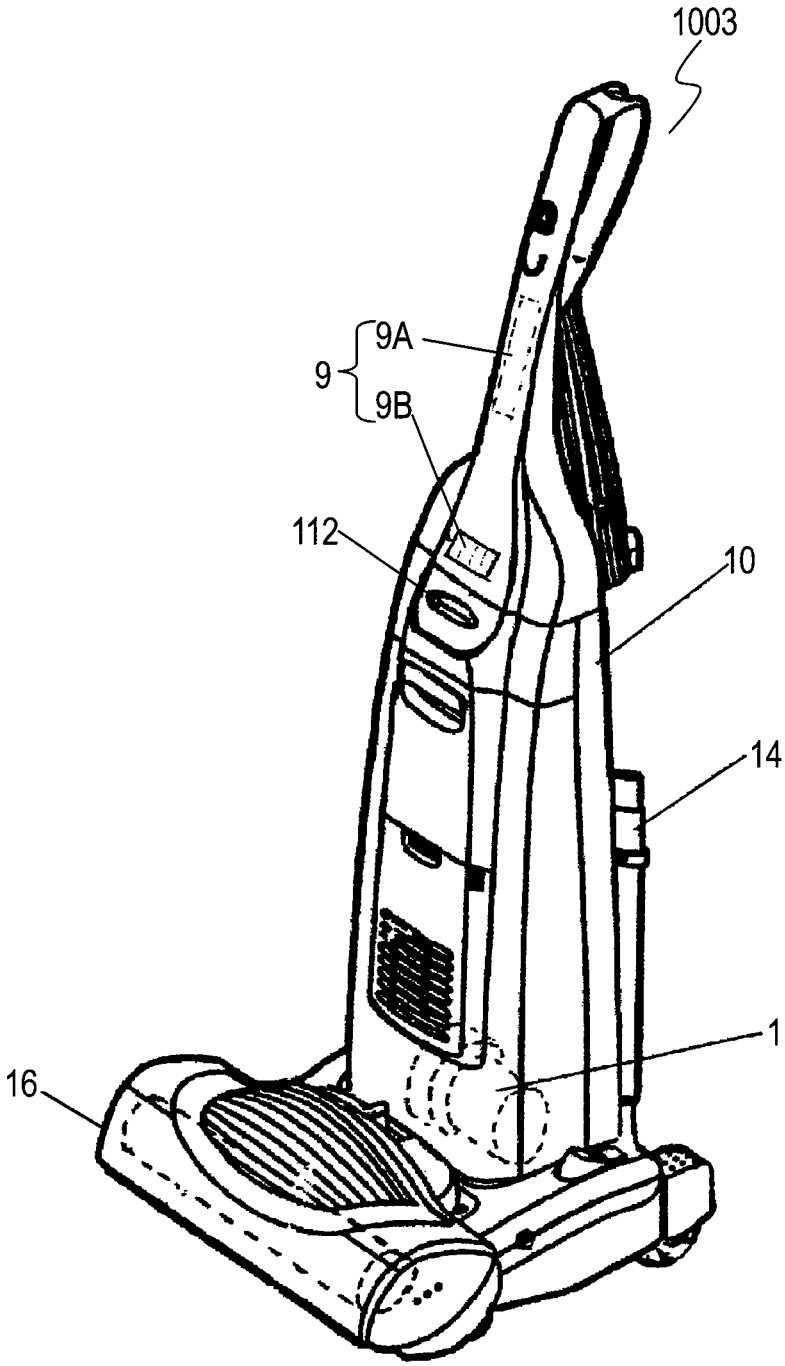
FIG. 9A is a perspective view of a vacuum cleaner according to Exemplary Embodiment 3 of the invention.
Figure 9B:
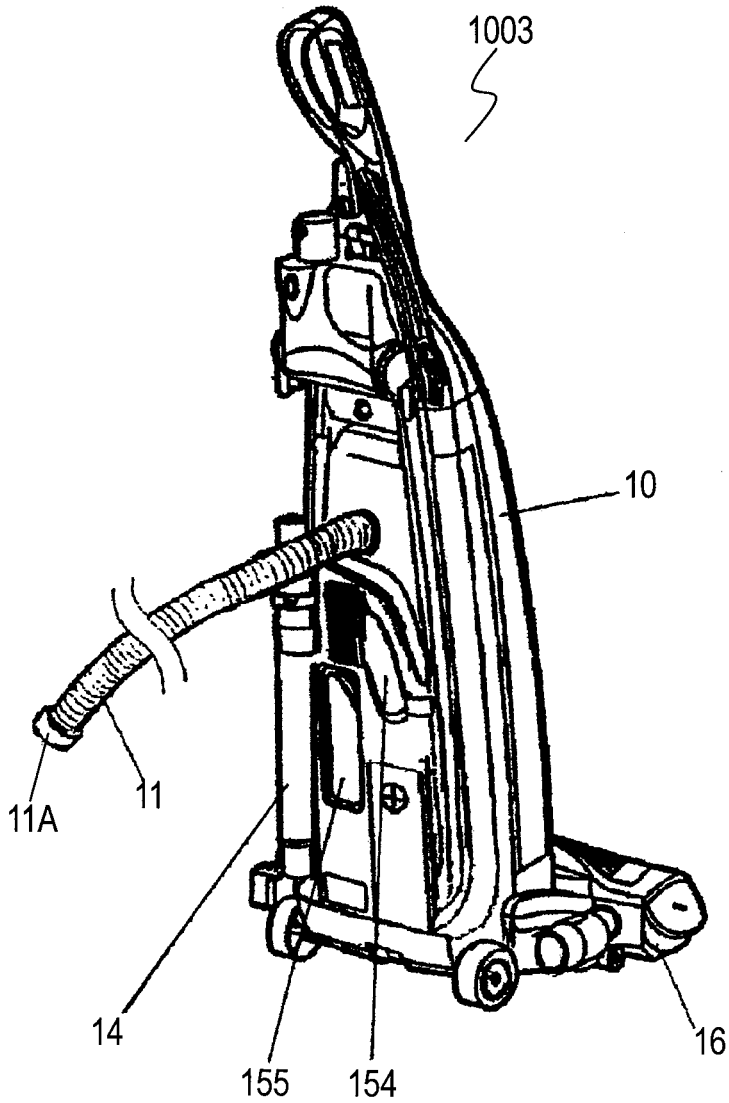
FIG. 9B is a rear perspective view of the vacuum cleaner according to Embodiment 2.
Figure 10:
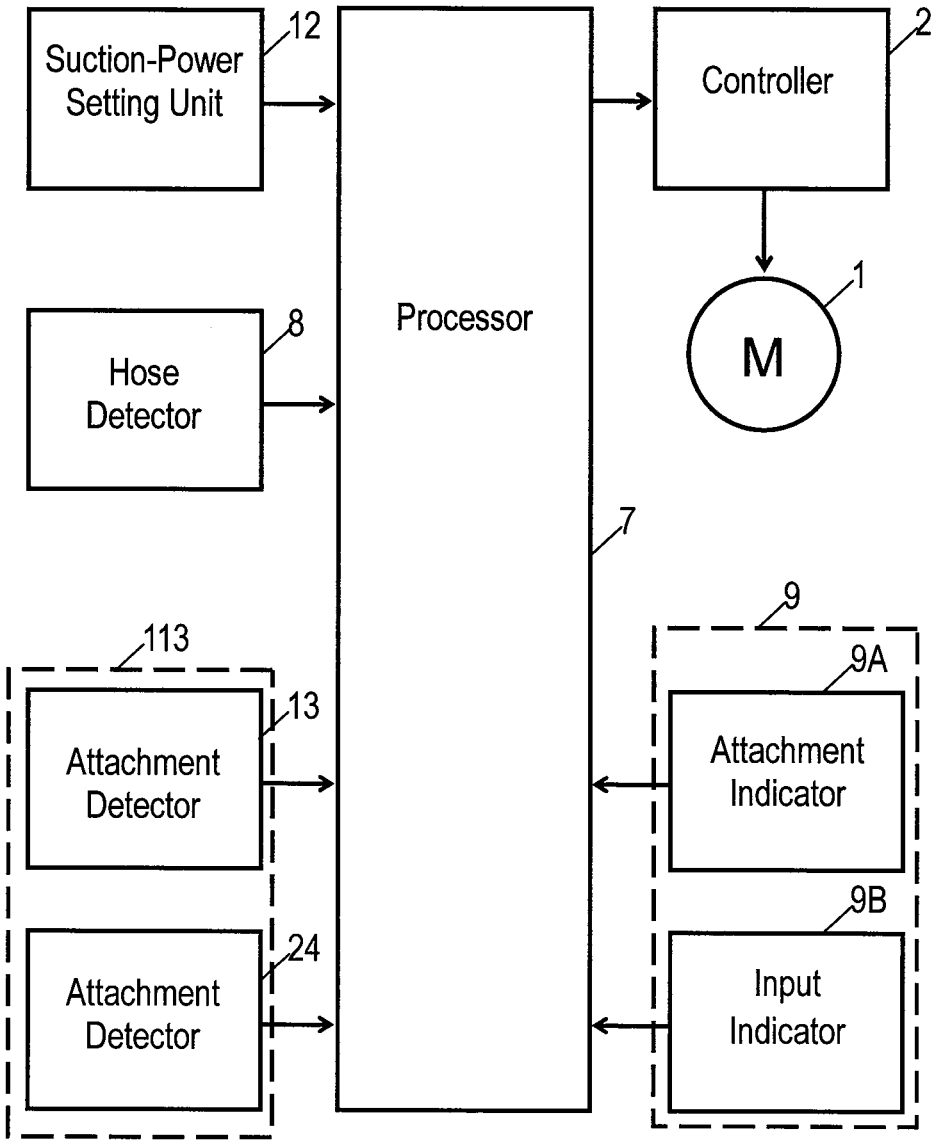
FIG. 10 is a circuit block diagram of the vacuum cleaner according to Embodiment 3.

FIG. 9A is a perspective view of vacuum cleaner 1003 according to Exemplary Embodiment 3 of the present invention. FIG. 9B is a rear perspective view of vacuum cleaner 1003. FIG. 10 is a circuit block diagram of vacuum cleaner 1003. In FIGS. 9A and 10, components identical to those of vacuum cleaners 1001 and 1002 according to Embodiments 1 and 2 shown in FIGS. 1 to 7 are denoted by the reference numerals, and their description will be omitted. Vacuum cleaner 1003 does not include mode detector 3 detecting whether cleaner body 10 stands in a standing mode or inclines in an ordinary cleaning mode.

Hose detector 8 detects whether or not hose 11 is attached to floor nozzle 16. First attachment detector 13 detects whether or not first attachment 14 (an extension pipe) is attached to cleaner body 10. Second attachment detector 24 detects whether or not second attachment 155 (a crevice nozzle) is attached to cleaner body 10. Second attachment detector 24 detects whether or not second attachment 155 is attached to cleaner body 10 with a microswitch provided at cleaner body 10 similarly to first attachment detector 13.

According to Embodiment 3, it is detected whether or not attachments, such as attachment 14 (the extension pipe) and attachment 155 (the crevice nozzle), to be attached to tip 11A of hose 11 are attached to cleaner body 10 in order to discriminate the type of an attachment that is not attached to (detached from) cleaner body 10 (an attachment attached to tip 11A of hose 11). Attachment detectors 13 and 24 thus provide attachment discriminator 113 discriminating an attachment not attached to cleaner body 10 (the attachment detached from cleaner body 10) out of plural attachments 14 and 155.

Figure 9C:
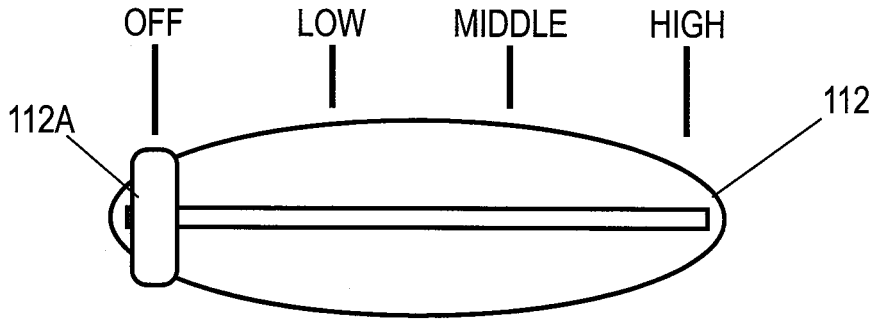
FIG. 9C is an enlarged partial view of the vacuum cleaner according to Embodiment 3.

FIG. 9C is an enlarged partial view of vacuum cleaner 1003 for illustrating suction-power setting section 112. The user can set a power supplied to electric blower 1 through suction-power setting section 112 only when at least one of attachments 14 and 155 is detached from cleaner body 10. When attachments 14, 155 are attached to cleaner body 10, the user cannot set the power through suction-power setting section 112. Suction-power setting section 112 includes lever 112A.

Figure 9D:
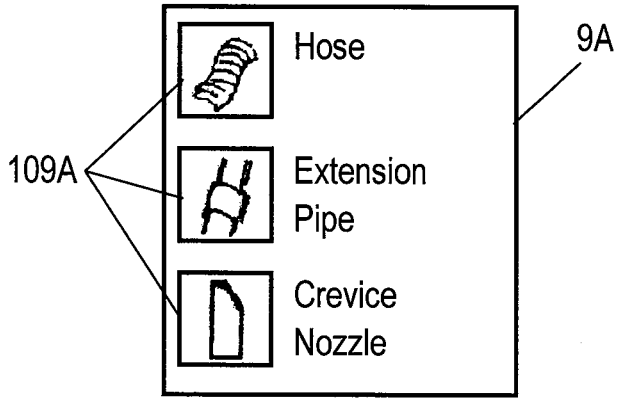
FIG. 9D is an enlarged partial view of the vacuum cleaner according to Embodiment 3.
Figure 9E:
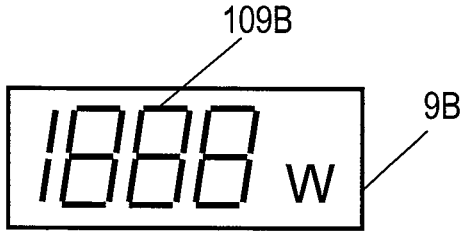
FIG. 9E is an enlarged partial view of the vacuum cleaner according to Embodiment 3.

FIGS. 9D and 9E are enlarged partial views of vacuum cleaner 1003 for illustrating attachment indicator 9A and input indicator 9B, respectively. Indicator 9 includes attachment indicator 9A and input indicator 9B. Attachment indicator 9A indicates an indication indicating that an attachment is not attached to cleaner body 10, namely the attachment is detached from cleaner body 10. Input indicator 9B indicates the power supplied to electric blower 1. Indicator 9 may not necessarily include either attachment indicator 9A or input indicator 9B.

Processor 7 calculates the power supplied to electric blower 1 according to signals from hose detector 8, first attachment detector 13, second attachment detector 24, and suction-power setting section 12. Processor 7 directs controller 2 to supply the power to electric blower 1, and directs input indicator 9B to indicate indication 109B corresponding to the power. Processor 7 directs attachment indicator 9A to indicate whether or not hose 11 is attached to floor nozzle 16, and additionally whether or not attachments 14 and 155 are attached to cleaner body 10.

In vacuum cleaner 1003 according to Embodiment 3, processor 7 sets the power supplied to electric blower 1 in the following manner. When hose 11 is attached to floor nozzle 16, processor 7 sets the power to 1000 W. When hose 11 is not attached, namely, is detached from floor nozzle 16, processor 7 sets the power to 1100 W. When first attachment 14 (the extension pipe) is not attached to cleaner body 10, namely, is detached from cleaner body 10, processor 7 sets the power to 1200 W. When second attachment 155 (the crevice nozzle) is not attached to cleaner body 10, namely, is detached from cleaner body 10, processor 7 sets the power to 700 W. When both attachments 14 and 155 are not attached to cleaner body 10, namely are detached from cleaner body 10, processor 7 sets the power to 800 W. The user positions lever 112A of suction-power setting section 112 to positions "LOW", "MIDDLE", or "HIGH" to set the power to 600 W, 900 W, or 1300 W, respectively. When the user does not operate suction setting section 112, the user positions lever 112A to a position "OFF".

Figure 11:
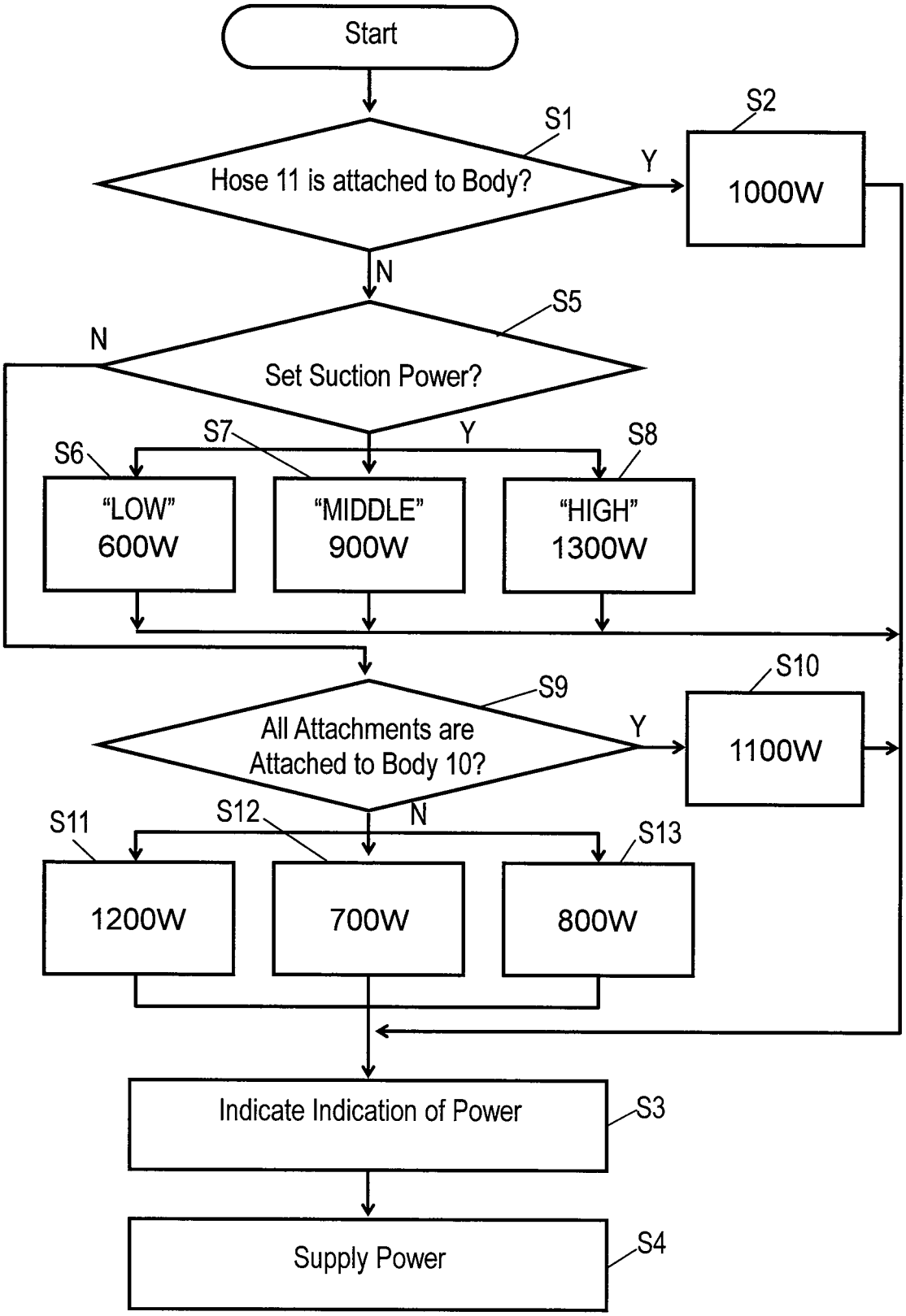
FIG. 11 is a flowchart illustrating an operation of the vacuum cleaner according to Embodiment 3.
Figure 12:
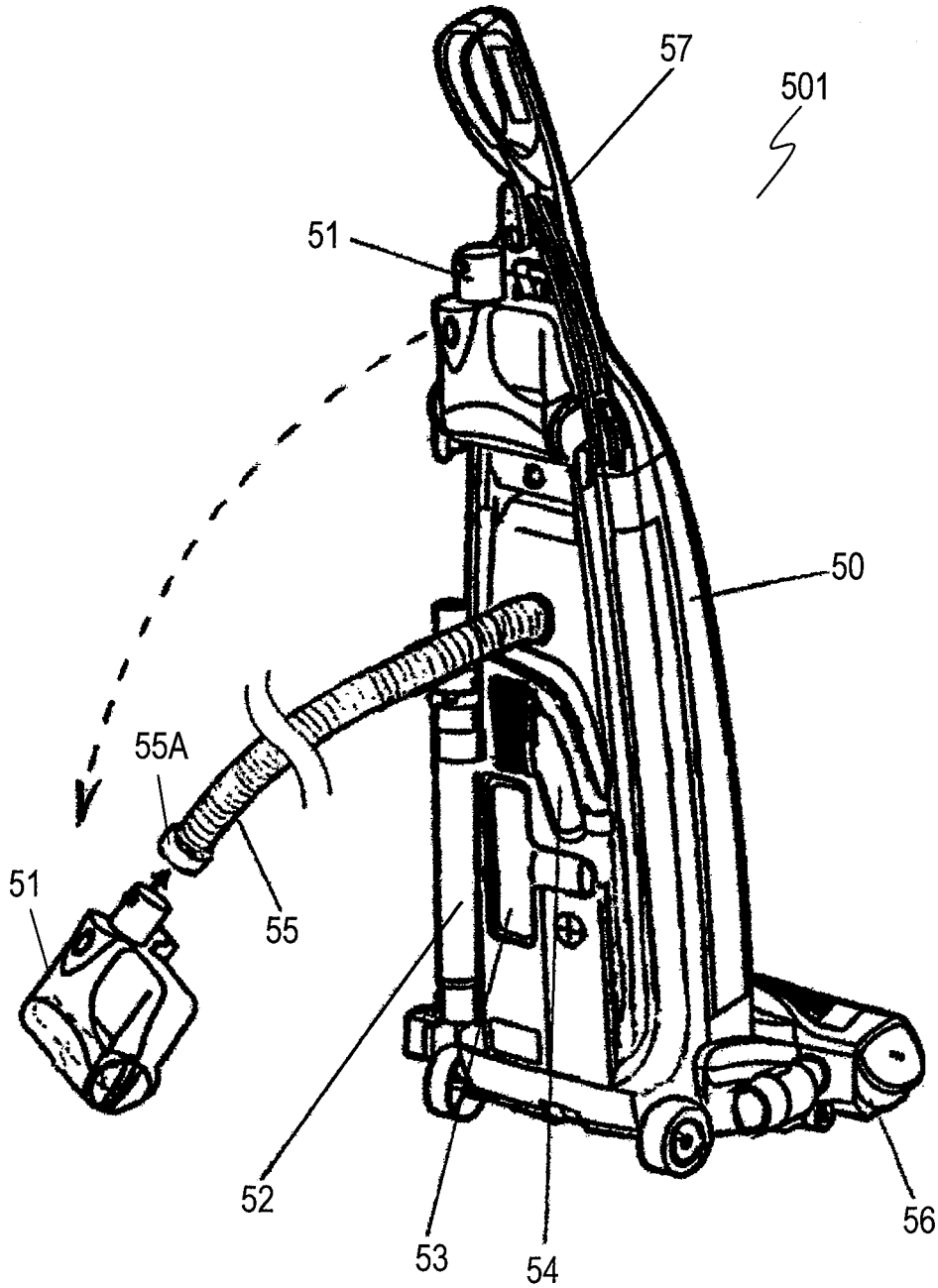
FIG. 12 is a rear perspective view of a conventional vacuum cleaner.

An operation of vacuum cleaner 1003 will be described below. FIG. 11 illustrates operations of circuit blocks of vacuum cleaner 1003 shown in FIG. 10.

If hose detector 8 detects that hose 11 is attached to floor nozzle 16 (Step S1), processor 7 sets power supplied to electric blower 1 to 1000 W regardless of a signal output from attachment detectors 13 and 24 (Step S2), directs input indicator 9B to indicate indication 109B corresponding to the power of 1000 W (Step S3), and directs controller 2 to supply the power of 1000 W to electric blower 1 (Step S4). This operation prevents the power supplied to electric blower 1 from accidentally changing even if attachments 14 and 155 are detached from cleaner body 10 when hose 11 is attached to floor nozzle 16.

If hose detector 8 detects that hose 11 is attached to floor nozzle 16 at Step S1, attachment detectors 13 and 24 forming the attachment discriminator 113 detect whether or not first attachment 14 and second attachment 155 are attached to cleaner body 10, respectively. If attachment discriminator 113 detects that at least one of first attachment 14 and second attachment 155 is not attached to cleaner body 10, namely, is detached from cleaner body 10, processor 7 directs attachment indicator 9A to indicate indication 109A corresponding to the attachment detached from cleaner body 10. This operation allows the user to easily notice which attachment is detached from cleaner body 10.

If hose detector 8 detects that hose 11 is not attached to floor nozzle 16, namely, is detached from floor nozzle 16 at Step S1, processor 7 detects whether or not the power supplied to electric blower 1 is set through suction-power setting section 112 (Step S5). If processor 7 detects at Step S5 that the power is set though suction-power setting section 112, namely, lever 112A is positioned at one of position "LOW", "MIDDLE", and "HIGH" other than the position "OFF", processor 7 sets the power supplied to electric blower 1 to 600 W, 900 W, or 1200 W set through suction-power setting section 112 (Steps S6 to S8). Further, processor 7 directs input indicator 9B to indicate indication 109B corresponding to the set power (Step S3), and directs controller 2 to supply the power to electric blower 1 (Step S4).

If processor 7 detects at Step S5 that the power supplied to electric blower 1 is not set through suction-power setting section 112, namely, lever 112A is positioned at the position "OFF", attachment detectors 13 and 24 forming attachment discriminator 113 detect whether or not all the attachments which are detectable (first attachment 14 and second attachment 155) are attached to cleaner body 10, respectively (Step S9). If attachment discriminator 113 determines at Step S9 that all the attachments are attached to cleaner body 10, namely, if attachment detectors 13 and 24 detect that first attachment 14 and second attachment 155 are attached to cleaner body 10, respectively, processor 7 sets the power supplied to electric blower 1 to 1100 W (Step S10), directs input indicator 9B to indicate indication 109B corresponding to the power of 1,100 W (Step S3), and directs controller 2 to supply the power of 1100 W to electric blower 1 (Step S4). In this case, attachment discriminator 113 determines at Step S9 that all the attachments which are detectable (attachments 14 and 155) are attached to cleaner body 10, namely, attachment detectors 13 and 24 detects that first attachment 14 and second attachment 155 are attached to cleaner body 10, respectively. Hence, processor 7 does not direct attachment indicator 9A to indicate indication 109A corresponding to an attachment detached. This operation allows the user to easily notice no attachment is detached from cleaner body 10.

If attachment discriminator 113 determines at Step S9 that at least one attachment is attached to cleaner body 10, the attachment discriminator discriminates which attachment is detached from cleaner body 10, and processor 7 sets the power supplied to electric blower 1 according to the detached attachment. When attachment detector 13 detects that first attachment 14 (the extension pipe) is detached from cleaner body 10 and additionally when attachment detector 24 detects that second attachment 155 (the crevice nozzle) is attached to cleaner body 10, processor 7 sets the power supplied to electric blower 1 to 1200 W (Step S11), directs input indicator 9B to indicate indication 109B corresponding to the power of 1200 W (Step S3), and directs controller 2 to supply the power of 1200 W to electric blower 1 (Step S4). When attachment detector 13 detects that first attachment 14 (the extension pipe) is attached to cleaner body 10 and additionally when attachment detector 24 detects that second attachment 155 (the crevice nozzle) is detached from cleaner body 10, processor 7 sets the power supplied to electric blower 1 to 800 W (Step S12), directs input indicator 9B to indicate indication 109B corresponding to the power of 800 W (step S3), and directs controller 2 to supply the power of 800 W to electric blower 1 (Step S4). When attachment detector 13 detects that first attachment 14 (the extension pipe) is detached from cleaner body 10 and additionally when attachment detector 24 detects that second attachment 155 (the crevice nozzle) is detached from cleaner body 10, processor 7 sets eth power supplied to electric blower 1 to 700 W (Step S13), directs input indicator 9B to indicate indication 109B corresponding to the power of 700 W (Step S3), and directs controller 2 to supply eth power of 700 W to electric blower 1 (Step S4). In this case, processor 7 directs attachment indicator 9A to indicate indication 109A corresponding to the attachment determined by attachment discriminator 113 as detached from cleaner body 10 at Step S9. This operation allows the user to easily notice which attachment is not attached to cleaner body 10, namely, is detached from cleaner body 10. That is, attachment discriminator 113 discriminates an attachment which is not attached to cleaner body 10, namely, which is detached from cleaner body 10, out of attachments 14 and 155. Controller 2 supplies the power corresponding to the attachment determined to electric blower 1.

Thus, if hose detector 8 detects that hose 11 is not attached to floor nozzle 16, namely, is detached from floor nozzle 16, controller 2 supplies, to electric blower 1, the power corresponding to the attachment determined. If hose detector 8 detects that hose 11 is attached to floor nozzle 16, controller 2 supplies, to electric blower 1, the power regardless of a detection result of attachment discriminator 113.

If hose detector 8 detects that hose 11 is not attached to floor nozzle 16, namely, is detached from floor nozzle 16, controller 2 supplies, to electric blower 1, the power set through suction-power setting section 112. If hose detector 8 detects that hose 16 is attached to floor nozzle 16, controller 2 supplies, to electric blower 1, the power regardless of power set through suction-power setting section 112.

Controller 2 supplies, to electric blower 1, the power according to a detection result of attachment detectors 13 and 24. If hose detector 8 detects that hose 11 is not attached to floor nozzle 16, namely, is detached from floor nozzle 16, controller 2 supplies, to electric blower 1, the power according to a detection result of attachment detector 13. If hose detector 8 detects that hose 11 is attached to floor nozzle 16, controller 2 supplies, to electric blower 1, the power regardless of a detection result of attachment detector 13.

In the case that cleaning is executed with attachment 14 (the extension pipe) connected to tip 11A of hose 11, vacuum cleaner 1003 according to Embodiment 3 detects that hose 11 and attachment 14 are detached from floor nozzle 16 and cleaner body 10, respectively. The power supplied to electric blower 1 if detecting that hose 11 is detached from floor nozzle 16 and additionally attachment 14 is detached from cleaner body 10 is higher than the power supplied to blower 1 if detecting exclusively one of that hose 11 is detached from floor nozzle 16 and that attachment 14 is detached from cleaner body 10. This operation compensates a suction loss at attachment 14 having high airflow resistance, thereby preventing the cleaning performance of vacuum cleaner 1003 from decreasing.

In the case that cleaning is executed with attachment 155 (the crevice nozzle) connected to tip 11A of hose 11, vacuum cleaner 1003 according to Embodiment 3 detects that hose 11 and attachment 14 are detached from floor nozzle 16 and cleaner body 10, respectively. The power supplied to electric blower 1 if detecting that hose 11 is detached from floor nozzle 16 and additionally attachment 155 is detached from cleaner body 10 is higher than the power supplied to blower 1 if detecting exclusively one of that hose 11 is detached from floor nozzle 16 and that attachment 155 is detached from cleaner body 10. This operation reduces suction noise generated at a narrow inlet of attachment 155 (the crevice nozzle).

If attachments 14 and 155 are detached from cleaner body 10 while hose 11 is attached to floor nozzle 16, the user easily notice whether or not attachments 14 and 155 are attached to attachment indicator 9A, allowing the user to notice that the attachments are not detached from cleaner body 10 intentionally.

In vacuum cleaner 1003 according to Embodiment 3, a suction power, namely, a power supplied to electric blower 1, can be set by the user through suction-power setting section 112. Hence, when the user thinks that the suction power is not sufficient when a certain attachment is used, the user sets the suction power to obtain desired cleaning performance and notices the power easily from input indicator 9B.

Vacuum cleaner 1003 according to Embodiment 3 detects whether or not attachments 14 and 155 are attached to cleaner body 10 to detect an attachment to be used. This structure eliminates wirings inside attachments 14 and 155, and detects whether or not even a general attachment is used.

Vacuum cleaner 1003 according to Embodiment 3 includes two attachments (attachments 14 and 155), however, the number of attachments may be more than two. In this case, attachment discriminator 113 includes attachment detectors each corresponding to an attachment to be used, and detects an attachment which is not attached to cleaner body 10, namely is detached from cleaner body 10, thus providing the same effects.

Embodiments 1 to 3 do not limit the invention.

INDUSTRIAL APPLICABILITY

A vacuum cleaner prevents an electric blower from overheating, and is applicable to various types of vacuum cleaners, for home, business, and stores.

The invention claimed is:

1. A vacuum cleaner comprising:

a cleaner body capable of standing and inclining;

an electric blower accommodated in the cleaner body;

a floor nozzle provided at a bottom of the cleaner body, the floor nozzle being capable of cleaning a surface while the cleaner body inclines;

a mode detector for detecting whether the cleaner body is in a standing position or is in an inclined position which is inclined relative to the standing position; and a hose detachably attached to the floor nozzle, the hose allowing the cleaner body to communicate with the floor nozzle; and a hose detector detecting whether or not the hose is attached to the floor nozzle, a controller operable to supply a first power level to the electric blower to provide a first amount of suction if the mode detector detects that the cleaner body is in the inclined position, and supply a second power level greater than zero and lower than the first power level to the electric blower to provide a second amount of suction greater than zero and lower than the first amount of suction if the mode detector detects that the cleaner body is in the standing position, and if the hose detector detects that the hose is attached to the floor nozzle, and supply a third power higher than the second power and lower than the first power level to the electric blower if the mode detector detects that the cleaner body stands and additionally the hose detector detects that the hose is detached from the floor nozzle.

2. The vacuum cleaner according to claim 1, further comprising a timer measuring a time elapsing after the cleaner body transitions from the inclined position to the standing position, wherein when the time elapsing reaches a predetermined time, the controller transitions from a) supplying power to the electric blower at the second power level to b) stopping to supply any power to the electric blower.

3. The vacuum cleaner according to claim 1, further comprising a suction-power setting section on the cleaner body, wherein when the mode detector detects that the cleaner body stands and the hose detector detects that the hose is detached from the floor nozzle, a user can change the third power level can be changed by operating the suction-power setting section, wherein the suction-power setting section includes a lever and the user can change the third power by operating the lever.

4. The vacuum cleaner according to claim 1, further comprising:

an attachment adapted to be detachably attached to the cleaner body and detachably attached to a tip of the hose; and an attachment detector detecting whether or not the attachment is attached to the cleaner body, wherein the controller changes a power supplied to the electric blower according to a detection result of the attachment detector.

5. The vacuum cleaner according to claim 4, further comprising a suction-power setting section by which a user can change a power level supplied to the electric blower, the suction-power setting section including a lever, wherein when the mode detector detects that the cleaner body stands and the hose detector detects that the hose is detached from the floor nozzle, the user can set the fourth power level higher than the third power level by operating the lever.

* * * * *